US006336338B1

(12) United States Patent
Koren

(10) Patent No.: US 6,336,338 B1
(45) Date of Patent: Jan. 8, 2002

(54) ROOM AIR CONDITIONER

(76) Inventor: Uri Koren, 5 Bet Hillel Street, Apartment 4, Ramat Gan, 52404 (IL)

( * ) Notice: Subject to any disclaimer, the term of this patent is extended or adjusted under 35 U.S.C. 154(b) by 0 days.

(21) Appl. No.: 09/709,426

(22) Filed: Nov. 13, 2000

(51) Int. Cl.[7] ..... F25D 23/12; F25D 17/06

(52) U.S. Cl. ..... 62/262; 62/263; 62/419; 62/91

(58) Field of Search ..... 62/279, 262, 263, 62/280, 419, 426, 91

(56) References Cited

U.S. PATENT DOCUMENTS 1,706,852 A * 3/1929 Kramer ..... 62/262
2,269,205 A * 1/1942 Hubbard ..... 62/262
2,549,547 A * 4/1951 Trask ..... 62/419
2,712,737 A * 7/1955 Palmer ..... 62/263
2,796,822 A * 6/1957 Nikolajevic ..... 62/262
2,797,559 A * 7/1957 Atchison ..... 62/262
3,176,474 A * 4/1965 Abbott ..... 62/262
3,298,193 A * 1/1967 Johnsen ..... 62/263
3,438,219 A * 4/1969 Brugler ..... 62/262
3,611,743 A * 10/1971 Manganaro ..... 62/262
3,740,964 A * 6/1973 Herweg ..... 62/262
5,222,374 A * 6/1993 Thompson et al. ..... 62/262
5,272,889 A * 12/1993 Harris ..... 62/429
5,295,531 A * 3/1994 Tsunekawa et al. ..... 165/48.1
5,415,011 A * 5/1995 Gilmore et al. ..... 62/262

* cited by examiner

*Primary Examiner*—William Doerrler
(74) *Attorney, Agent, or Firm*—Mark M. Friedman

(57) ABSTRACT

A room air conditioner mounted on an external building wall, comprising an indoor unit, an outdoor unit and an interface unit. The indoor unit includes an indoor cabinet having a suction opening and outlet port for indoor air, an indoor heat exchanger, and an indoor fan. The outdoor unit includes an outdoor cabinet having a suction opening and outlet port for fresh air, an outdoor heat exchanger, an outdoor fan and a fan motor which engages the outdoor and indoor fans. The interface unit is mounted in the external building wall and includes a fan drive shaft engaged at the first end by the fan motor in the outdoor cabinet and engaging the indoor fan. The room air conditioner produces less noise compared to room air conditioners of the prior art, while requiring a significantly smaller exterior wall opening for installation, at the same time providing the flexibility to permit the introduction to the room of fresh outside air, the humidification of heated air in the heating mode, and the cooling or heating of air in more than one room.

19 Claims, 11 Drawing Sheets

ROOM AIR CONDITIONER

FIELD AND BACKGROUND OF THE INVENTION

The present invention relates to room air conditioners and, in particular, it concerns a design in which the room air conditioner is split into indoor and outdoor units interconnected using an interface unit mounted in an external wall.

It is known that the room air conditioner is an inexpensive, and thus desirable, alternative to the split-type air conditioning system in which the indoor and outdoor sections are separated physically and housed in separate cabinets. The installation of a room air conditioner requires a large opening in the external building wall, such that the room air conditioner is relatively noisy. Moreover, the capacity of a room air conditioner to heat or cool is generally limited to a single room because of space limitations and the additional noise produced by higher capacity units.

Split type air conditioners, unlike room air conditioners, generally produce characteristically lower noise levels in the room. Other potential advantages include the capacity to heat or cool several rooms, and a requirement for a relatively small opening in the external building wall.

A conventional room air conditioner will be described with reference to the drawings to particularly point out the characterizing features thereof. FIG. 1 is a sectional side view of a conventional air conditioner of the vertical type; FIG. 2 is a sectional view taken along the line II—II of FIG. 1. As shown in these figures, the room air conditioner includes a cabinet 1, the interior of which is divided into an indoor portion 10 and an outdoor portion 11 by a partition plate 12 secured to a bottom 9 of the cabinet 1. A motor 5 is supported on a side of partition plate 12, which faces the outdoor portion 11 of cabinet 1 and includes horizontally-disposed (i.e., parallel to bottom 9) rotary shaft 5*a*. A portion of rotary shaft 5*a* penetrates partition plate 12 and extends into the indoor portion 10.

Mounted in the indoor portion 10 of cabinet 1 are a centrifugal fan 3 secured to rotary shaft 5*a,* a spiral casing 4 secured to partition plate 12 and disposed in enclosing relation to centrifugal fan 3, and an indoor heat exchanger 2 located adjacent to spiral casing 4 on a side thereof opposite centrifugal fan 3. Housed in the outdoor portion 11 of cabinet 1 are a propeller fan 6 secured to rotary shaft 5*a* of fan motor 5, an outdoor heat exchanger 7 disposed in spaced juxtaposed relation to propeller fan 6, a cover 15 interconnecting propeller fan 6 to outdoor heat exchanger 7, and a compressor 8 mounted on the bottom 9. Inlet ports 1*a* for introducing air into the interior of the cabinet are formed at opposite sides of the outdoor portion 11 of cabinet 1.

In the room air conditioner described above, fan motor 5 and compressor 8 are actuated, such that a refrigerant compressed in compressor 8 has its temperature raised. The heated refrigerant is supplied to outdoor heat exchanger 7 and is cooled by a stream of air B produced by the rotation of propeller fan 6. Subsequently, the cooled refrigerant is supplied to indoor heat exchanger 2, where the refrigerant is expanded to cool indoor heat exchanger 2, such that a stream of air A produced by the rotation of centrifugal fan 3 is cooled by indoor heat exchanger 2. The refrigerant is then returned to compressor 8.

There are several disadvantages associated with the above-described room air conditioner of the prior art, including:

a. The arrangement in which indoor heat exchanger 2, centrifugal fan 3, fan motor 5, propeller fan 6 and outdoor heat exchanger 7 are interconnected necessitates mounting all the aforementioned components in a single cabinet 1 together with compressor 8, resulting in the exposure of the room occupants to noisy mechanical system components.

b. The aforementioned arrangement in which indoor heat exchanger 2, centrifugal fan 3, fan motor 5, propeller fan 6 and outdoor heat exchanger 7 are interconnected such as to necessitate the mounting of all the aforementioned components in a single cabinet 1 together with the compressor 8, necessitates the provision of a large opening in the external building wall for installation of the air conditioner.

c. The effective cooling capacity of the air conditioner is generally limited to a single room, due to the high-level noise emissions and other design constraints.

There is therefore a recognized need for, and it would be highly advantageous to have, a low-cost room air conditioner having the advantages of split type air conditioners: low-level noise emissions, small opening requirement, and capacity to heat or cool more than a single room.

SUMMARY OF THE INVENTION

The present invention is a room air conditioner in which the indoor and outdoor sections are housed in separate cabinets and an interface unit is provided to interconnect various components including the heat exchangers, and to couple the indoor centrifugal fan to the fan motor housed in the external cabinet.

According to the teachings of the present invention there is provided, a room air conditioner in which noisy system components are housed external to the room, resulting in lower exposure of room occupants to noise.

According to yet another aspect of the present invention there is provided a room air conditioner with means for connecting the external and internal sections which permits the use of a minimally sized opening in the external building wall.

According to further features in the described preferred embodiments, the reduced noise exposure to room occupants provided, and the use of a minimally sized external building wall opening, permit the installation of a larger capacity room air conditioner which is capable of handling the air conditioning load of more than one room. This is accomplished in one preferred embodiment of the invention by means of connecting the interior unit air outlet port to a two-way damper and to air ducting so as to convey conditioned air to one or more additional rooms.

According to yet further features in the preferred embodiments, there is provided a room air conditioner having means of introducing fresh air into the room through the interface unit, while permitting installation using a minimally sized external building wall opening. According to yet further features in the preferred embodiments, there is provided a room air conditioner with many of the advantages of split-type air conditioners such as low noise production, high capacities capable of handling more than one room, and small external wall opening needed for installation, with minimal thermal efficiency losses due to the small distance between the indoor and outdoor heat exchangers.

According to yet further features in the preferred embodiments, there is provided a room air conditioner having means of using condensate water to humidify heated indoor air in the heating mode and to cool the exterior heat exchanger (condenser) in the cooling mode.

The present invention successfully addresses the shortcomings of the existing technologies by providing a design for reducing indoor noise levels of the room air conditioner and eliminating the need for providing a large installation opening in the external building wall. Consequently, the design allows the implementation of inexpensive, larger capacity room air conditioners that are capable of air conditioning more than one room.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

The present invention is a room air conditioner in which the interior and exterior sections are interconnected by an interface unit which connects the heat exchangers, transfers rotary motion from an electric motor positioned in the exterior unit to the fan positioned in the interior unit, transfers condensate water between interior and exterior sections, and provides a means to transfer fresh outside air to the fan casing in the interior unit for conveyance to the room interior.

The principles and operation of the room air conditioner according to the present invention may be better understood with reference to the drawings and the accompanying description.

Figure 1:
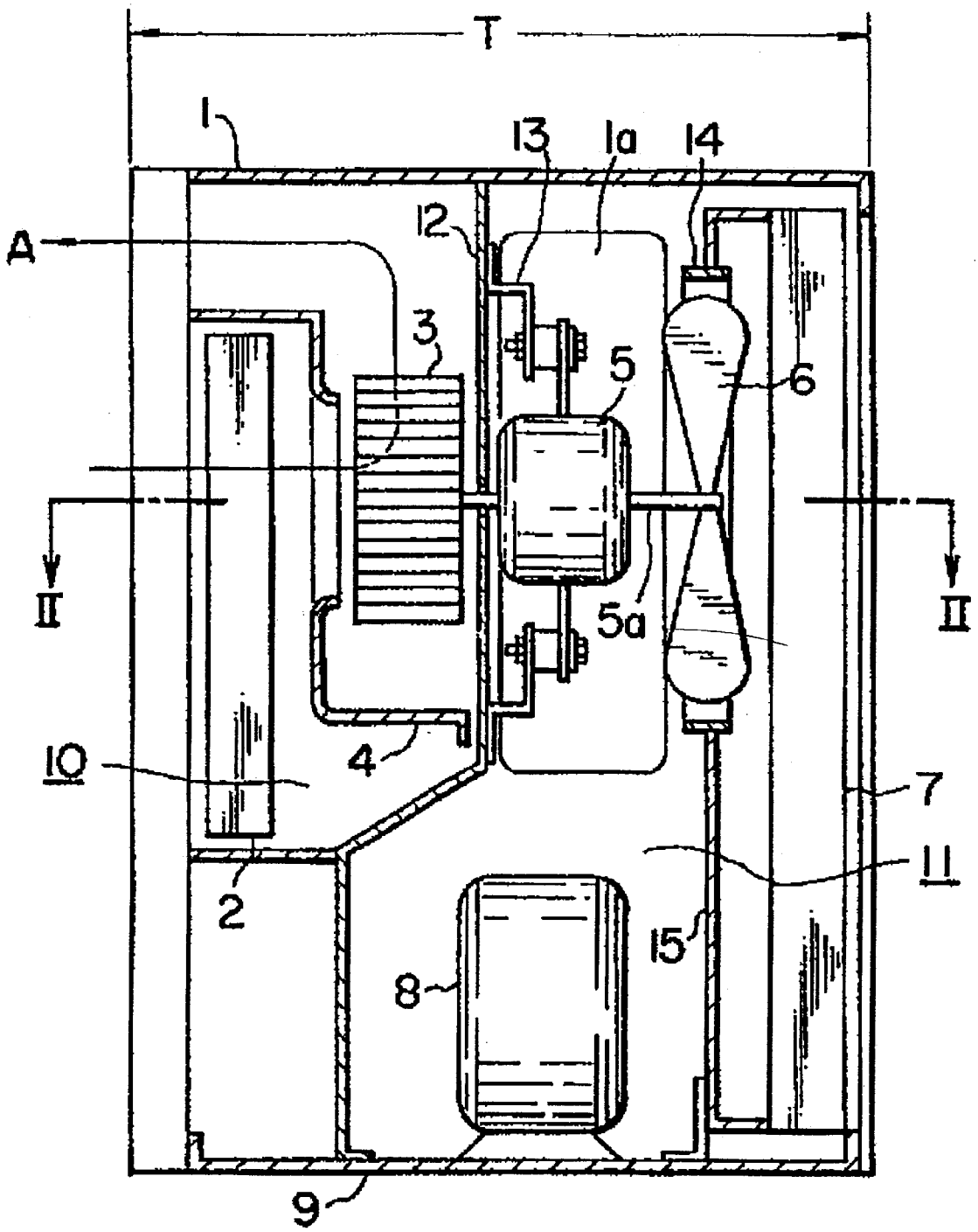
FIG. 1 PRIOR ART
FIG. 1 is a sectional side view schematically showing a vertical type room air conditioner of the prior art.
Figure 2:
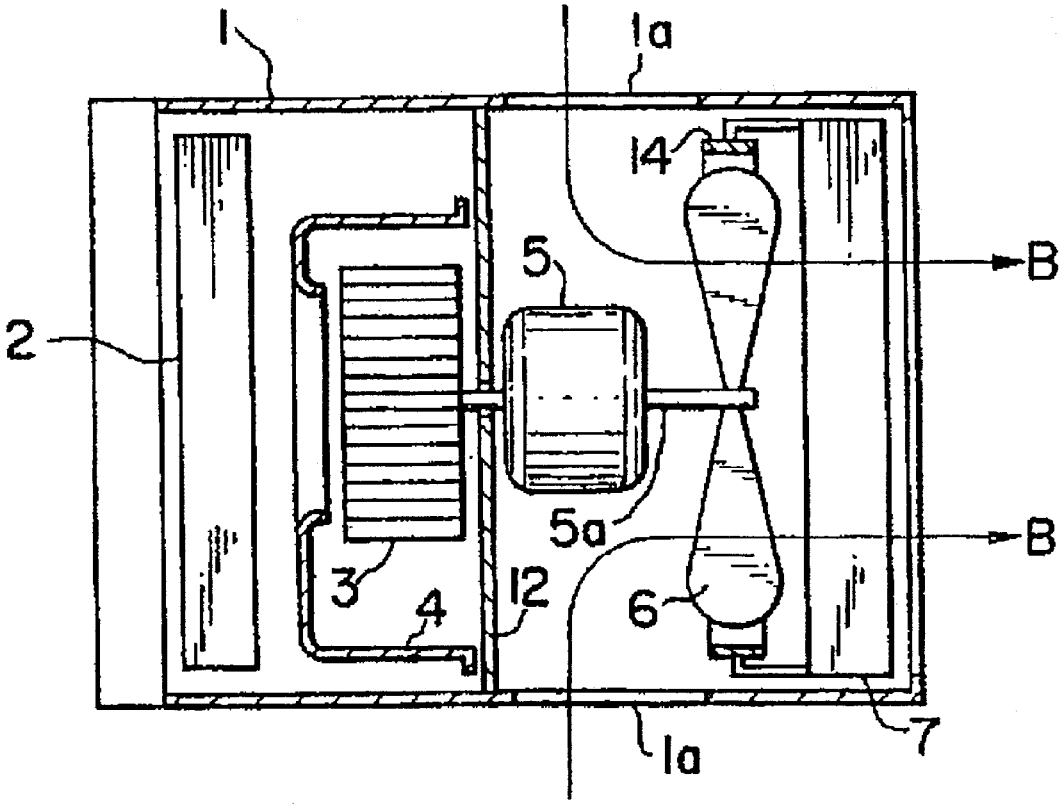
FIG. 2 PRIOR ART
FIG. 2 is a sectional view taken along the line II—II of FIG. 1.
Figure 3:
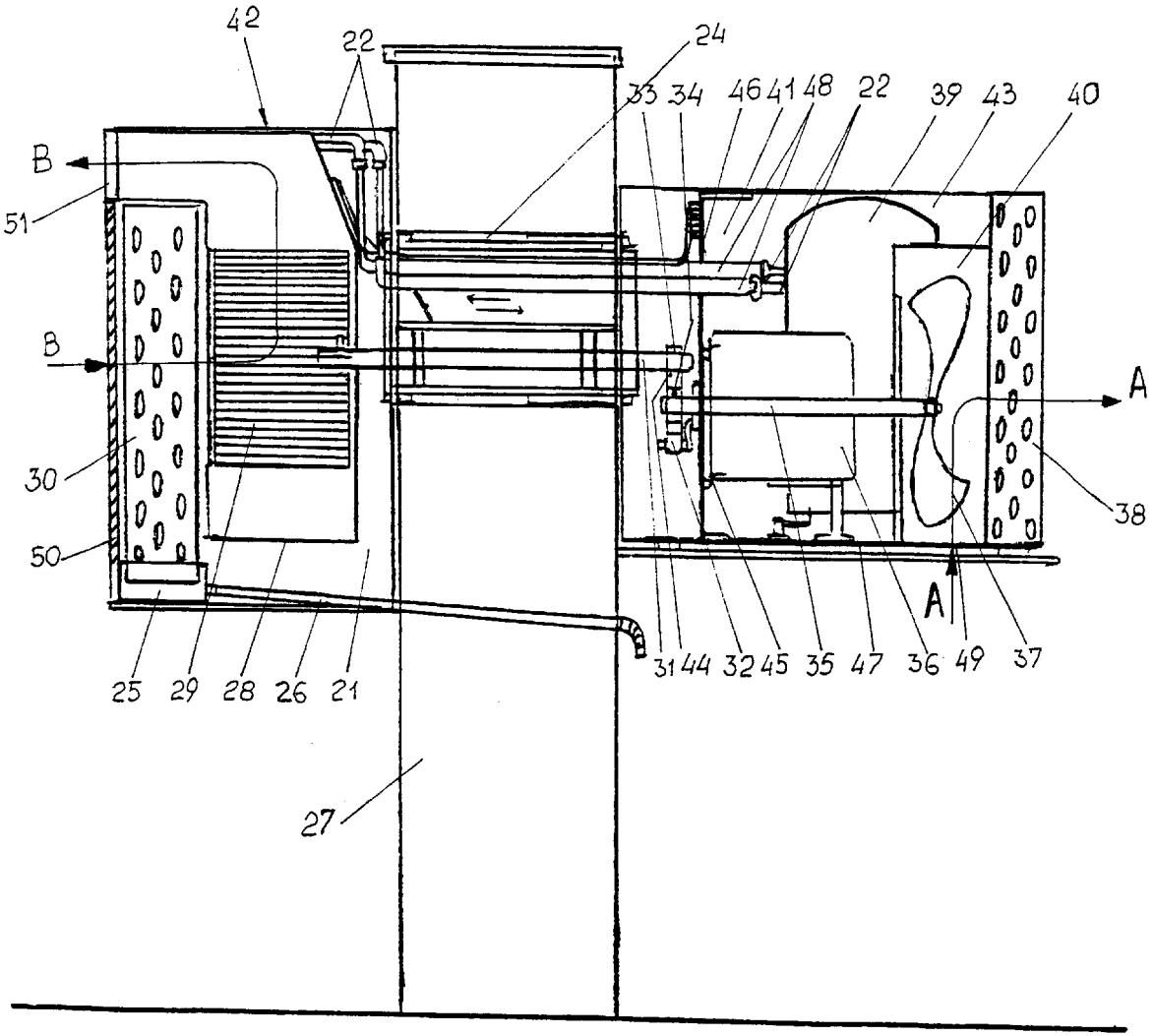
FIG. 3 is a sectional side view of a room air conditioner comprising one embodiment of the invention.
Figure 3A:
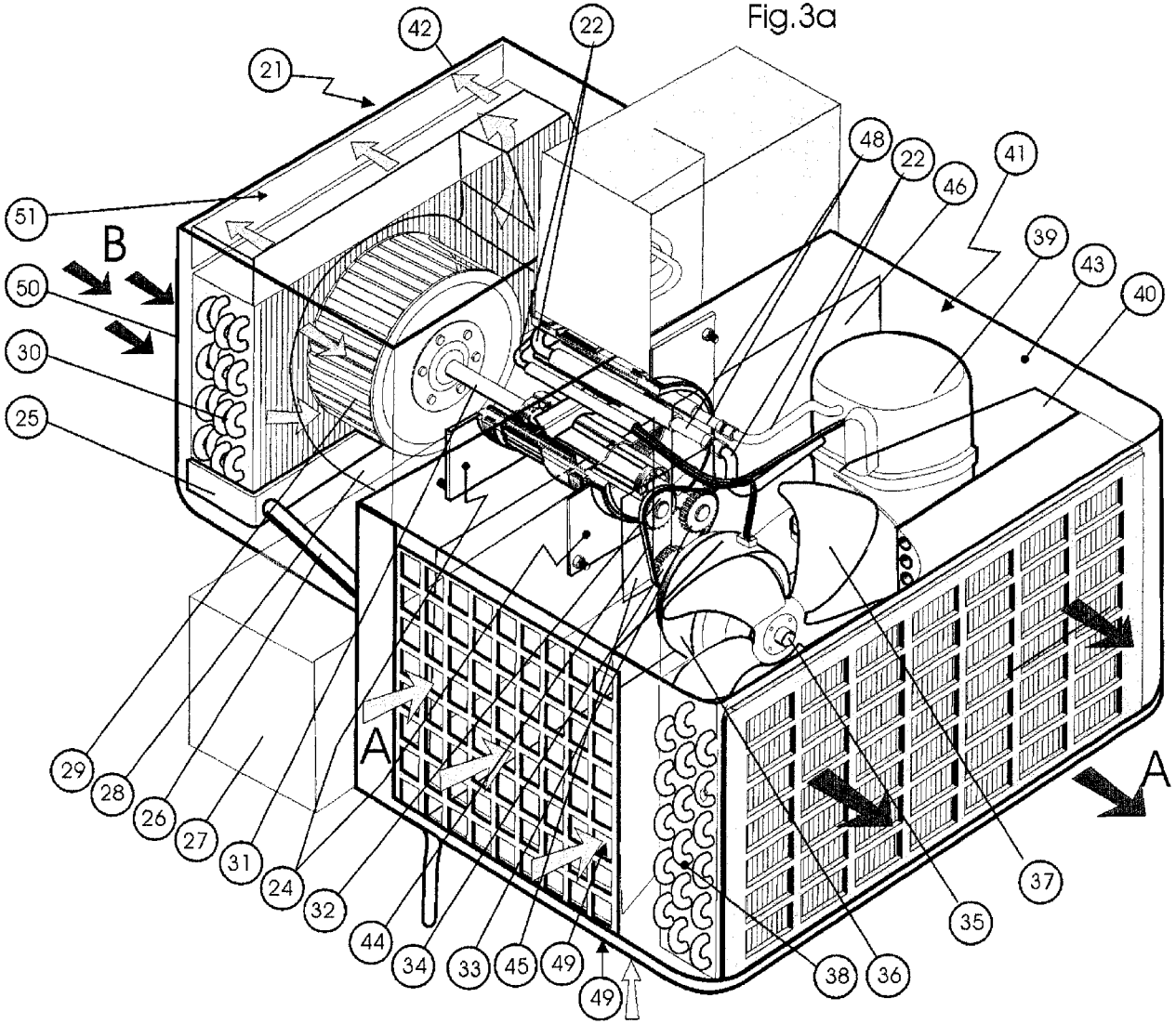
FIG. 3*a* is an isometric view of the room air conditioner shown in FIG. 3.
Figure 4:
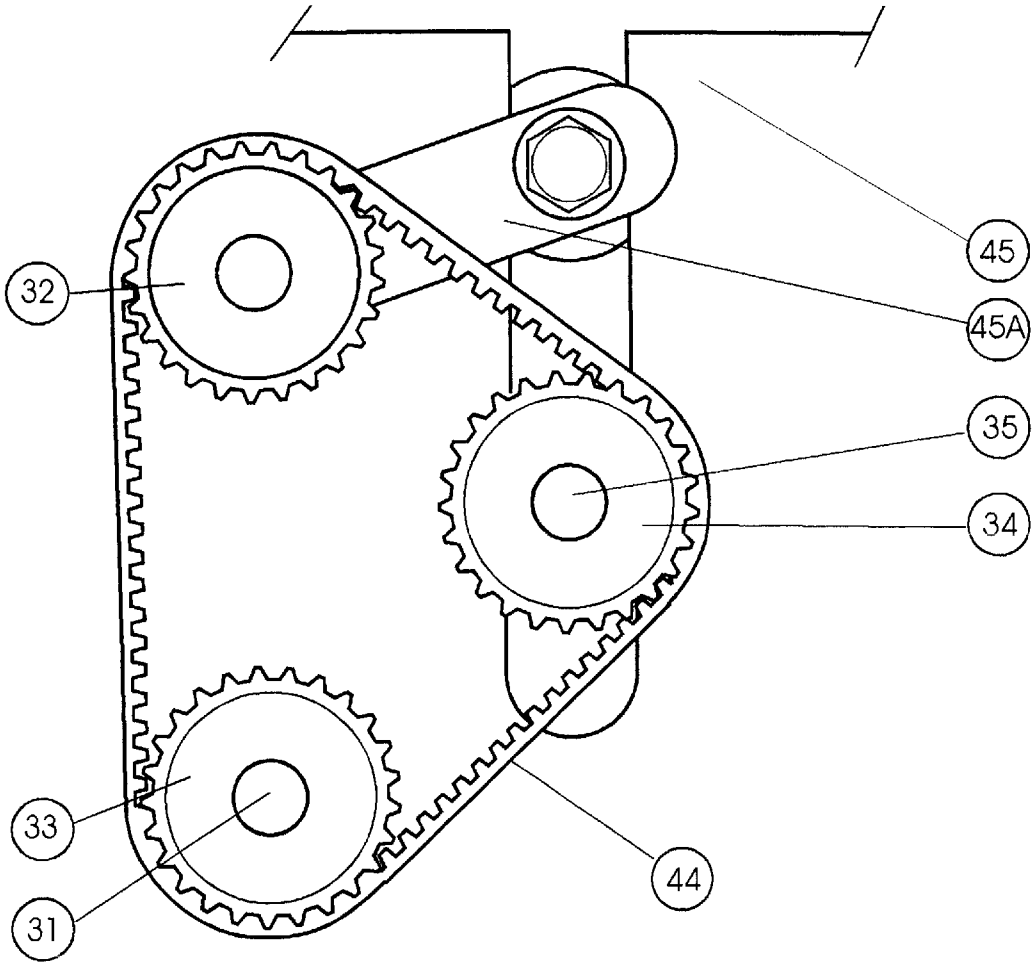
FIG. 4 is a frontal view of a belt and pulley assembly for connecting the fan motor to the rotary shaft, according to one embodiment of the present invention.

Before explaining at least one embodiment of the invention in detail, it is to be understood that the invention is not limited in its application to the details of construction and the arrangement of the components set forth in the following description or illustrated in the drawing. The invention is capable of other embodiments or of being practiced or carried out in various ways. Also, it is to be understood that the phraseology and terminology employed herein is for the purpose of description and should not be regarded as limiting Referring now to the drawings, FIG. 3 and FIG. 3*a* illustrate one form of the apparatus constructed in accordance with the present invention. As shown in FIG. 3 and FIG. 3*a,* one embodiment of the invention described herein consists of an interior unit 21, an exterior unit 41 and an interface unit 24 for connecting interior unit 21 and exterior unit 41. Mounted within interior unit cabinet 42 is a heat exchanger 30, a condensed water collection pan 25 and drain tube 26. In addition, water can be drained through tubes installed in the interface unit using a reversible water pump (see FIG. 7 and FIG. 7*a*), allowing use of the water for cooling the exterior unit 41 heat exchanger 38 in the air cooling mode or for humidifying the heated fresh air in the air heating mode. A single suction centrifugal fan 29 is mounted to one end of a rotary shaft 31 within a spiral casing 28 which is disposed in spaced juxtaposed relation to the indoor heat exchanger 30. The rotary shaft 31 is supported on bearings mounted in the interface unit 24 and extends into the exterior unit 41 where it is connected to the electric fan motor 36 rotary shaft 35 by a belt and pulley assembly in this embodiment of the invention. The belt and pulley assembly, shown in FIG. 3 and FIG. 3*a* and in greater detail in FIG. 4, consists of a pulley 33 attached to the rotary shaft 31, a pulley 34 attached to the fan electric motor rotary shaft 35, an adjustable tension pulley 32 attached to the back of the motor casing 45 using pivot arm 45*a,* and a fan belt 44 which engages the respective pulleys 32, 33, 34. Other suitable means for engaging the electric fan motor shaft 35 to rotary shaft 31, such as a gear-based system, can be used.

The electric fan motor 36 is mounted to the exterior unit vertical partition plate 46 and base plate 47. An axial propeller fan 37 is attached to the end of the electric fan motor rotary shaft 35. The compressor 39 is mounted on the exterior unit base plate 47. Compressor 39, interior heat exchanger 30 and exterior heat exchanger 38 are interconnected using tubing 22 mounted within interior unit 21 and exterior unit 41, and tubing segments 48 mounted within interface unit 24.

In the above-described air conditioner, actuation of compressor 39 causes the refrigerant compressed in compressor 39 to be supplied to exterior heat exchanger 38. Meanwhile, actuation of fan motor 36 causes axial propeller fan 37 to rotate, thereby resulting in a negative pressure prevailing in casing 40 so that fresh air is drawn by suction through suction opening 49 in exterior unit cabinet 43, and is caused to pass through exterior heat exchanger 38 (see stream of air A). Thus, the refrigerant which was heated by being compressed in compressor 39 is cooled and condensed in exterior heat exchanger 38. The refrigerant, which is transferred from exterior heat exchanger 38 to interior heat exchanger 30, is expanded, thereby cooling interior heat exchanger 30. Meanwhile, rotation of the fan motor 36 causes single suction centrifugal fan 29 to rotate, thereby causing a subatmospheric pressure to prevail in spiral casing 28, so that indoor air is drawn by suction through suction opening 50 and is caused to pass through interior heat exchanger 30 (see stream of air B). At this time, the air drawn by suction is cooled by being brought into contact with the cooled interior heat exchanger 30, and the cooled air is exhausted into the room again through outlet port 51 of spiral casing 28 by means of single suction centrifugal fan 29.

Figure 5:
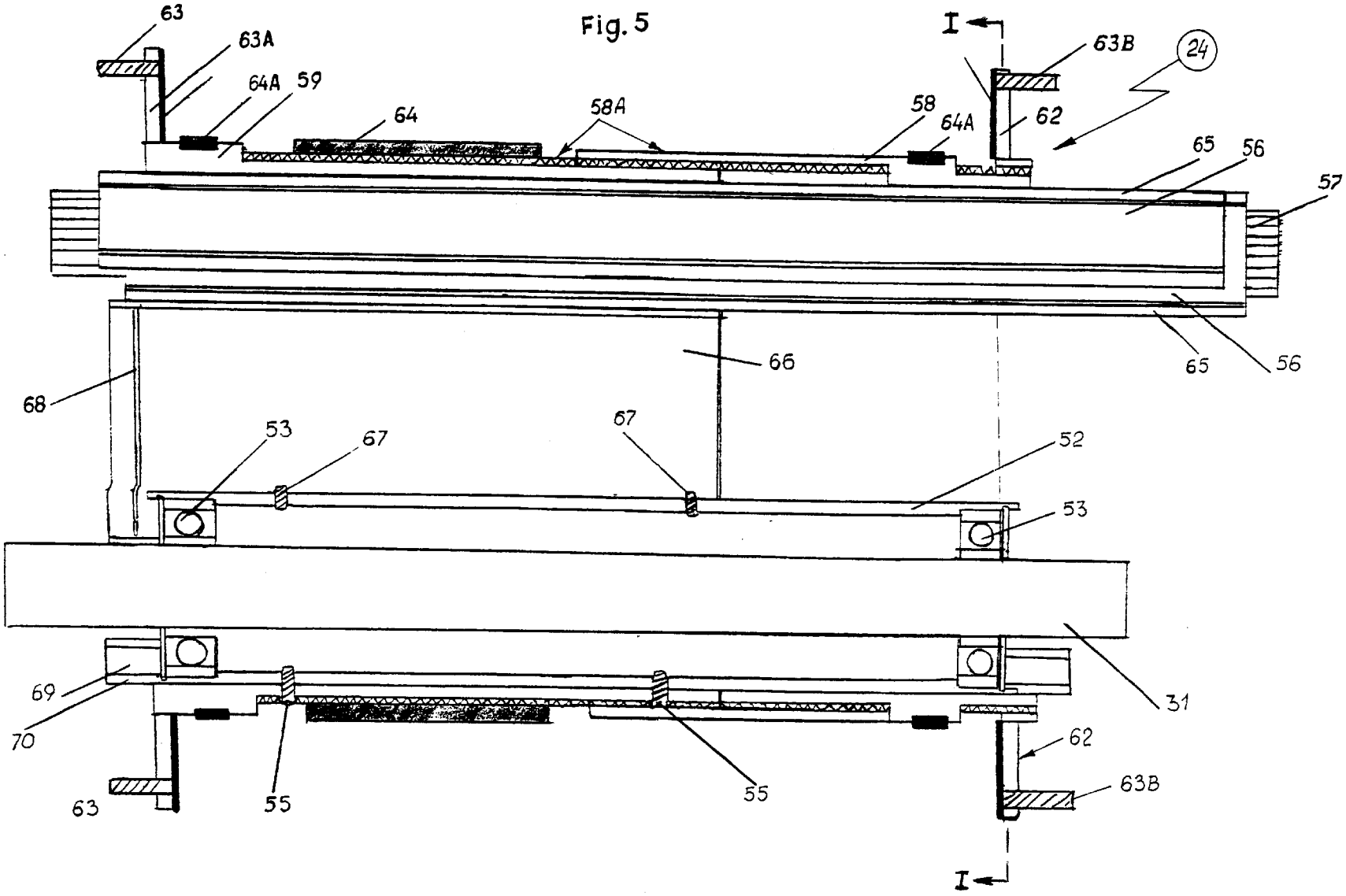
FIG. 5 is a sectional side view of the interface unit according to a preferred embodiment.
Figure 5A:
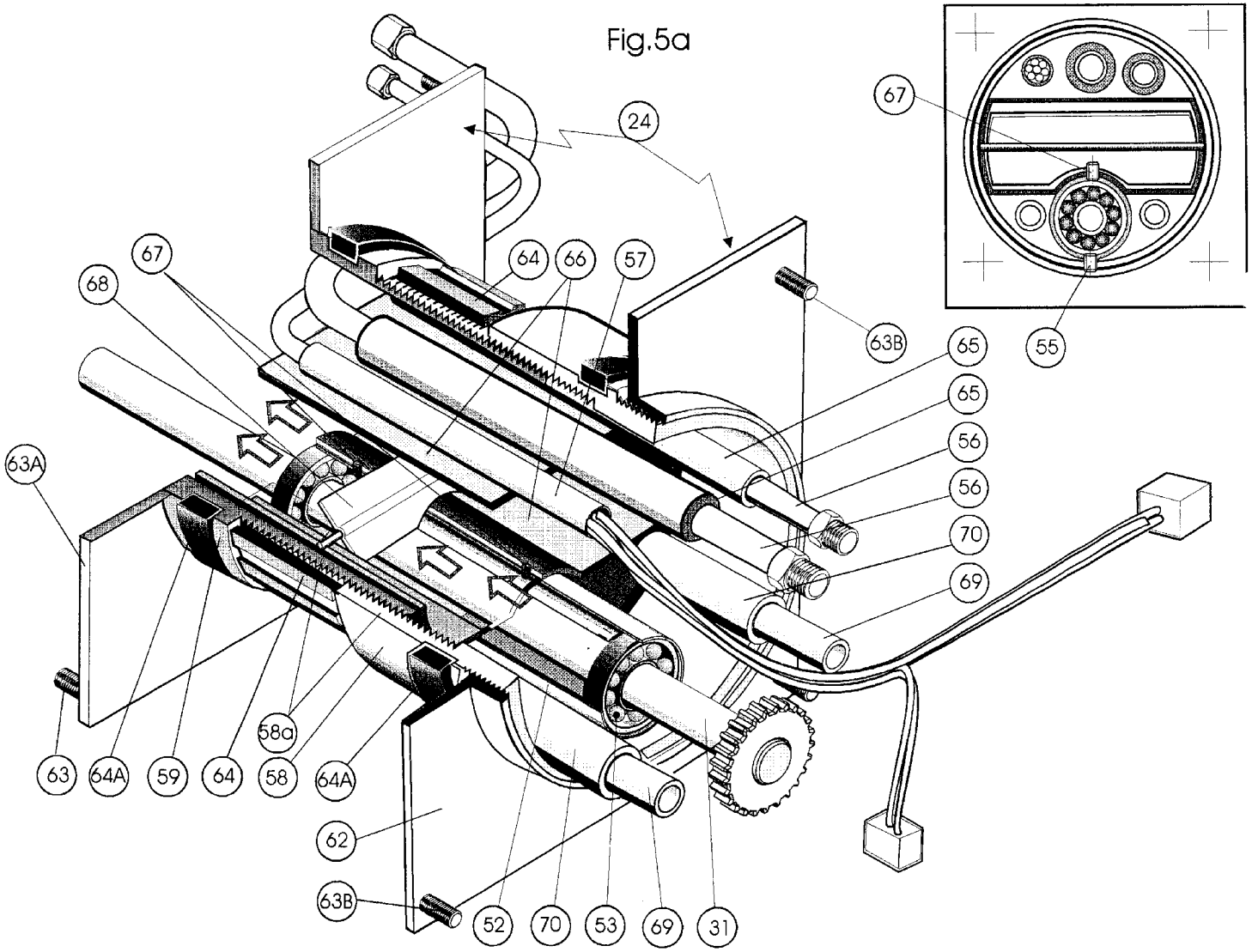
FIG. 5*a* is an isometric view of the interface unit shown in FIG. 5.

FIG. 5 is a cross sectional detailed schematic diagram of interface unit 24 provided in FIG. 3 and FIG. 3*a*. FIG. 5*a* is an isometric view of the same interface unit. The interface unit casing 58A is composed of an outer pipe section 58 threaded on its inner surface and an inner pipe section 59 threaded on its outer surface having appropriate diameters so as to mate with each other and to provide space to house the necessary components. The outer pipe section 58 is assembled onto inner pipe section 59 by engaging the screw threads. Thus, the length of the resulting two piece pipe assembly, which comprises the casing 58A of interface unit 24, is adjustable to permit installation of the interface unit 24 casing 58A in exterior building walls of various thicknesses. The interface unit casing 58A is secured to the rear panel of the interior unit cabinet 42 using fastening plate 63A and bolts 63, and to the exterior building wall surface using threaded fastening plate 62. The interface unit casing 58A is secured to the rear panel of the exterior unit cabinet 43 using bolts 63B.

The rotary shaft 31 is mounted in the bearing housing tube 52 which is secured to the inner surface of interface unit 24 by two Allen screws 55, and rotates when engaged by fan motor 36 while supported by bearings 53, inserted at each end of bearing housing 52. Connection of interior unit heat exchanger 30 and exterior unit heat exchanger 38 is effected by refrigerant tubes 56 fitted with suitable tubing connections at each end. Electrical signals and power are transferred from interior unit 21 to exterior unit 41 through electrical cable 57.

A channel 66 for conveying fresh air from exterior unit 41 to interior unit 21 for injection of fresh air into the conditioned air stream is disposed between bearing casing 52 and electrical cables 57 and refrigeration tubing 56.

A grooved or other suitable type flexible rubber sleeve 64 and rubber rings 64A or, alternatively or in addition, rubber O-rings are installed over inner pipe section 59 of interface unit 24 to absorb mechanical vibrations, thereby minimizing the conduction of vibrations from interface unit 24 to building wall 27.

Figure 6:
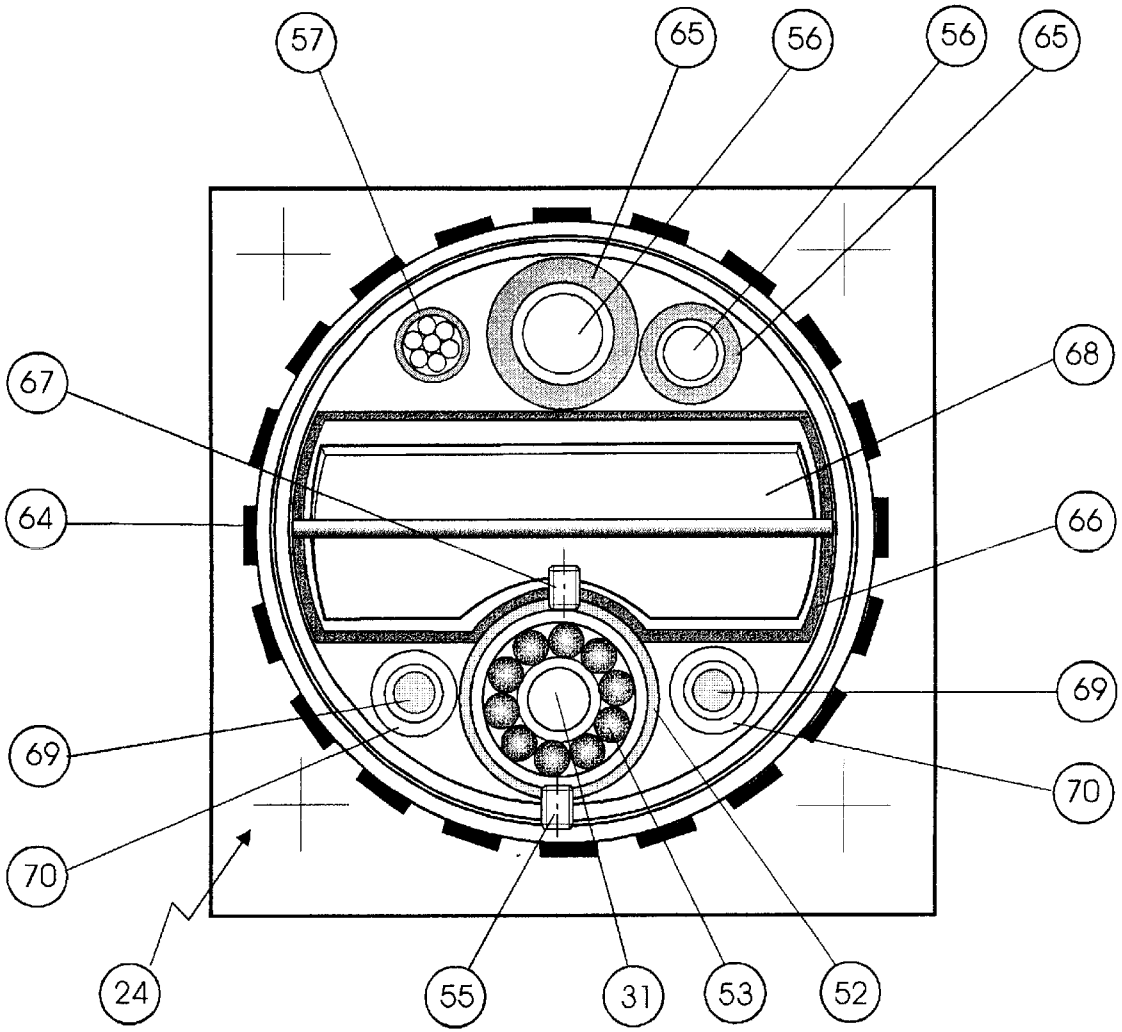
FIG. 6 is a sectional view of the interface unit taken along the line I—I of FIG. 5.

FIG. 6 is a sectional view of the interface unit taken along the line I—I of FIG. 5. In this figure, electrical cable bundle 57 is shown disposed near the top of interface unit 24 alongside two refrigeration tubes 56, each wrapped with a layer of thermal insulation 65. Below the aforementioned cable bundle 57, refrigeration tubes 56 and insulation 65 is a channel 66 for conveying fresh air from the outdoor unit to the indoor unit. An adjustable damper 68 shown in the present figure in the fully open position, mounted in the center of channel 66, is used to manually adjust the available cross sectional area of the channel 66, thereby regulating the flow of air within channel 66. The damper is fitted with a layer of thermal insulation on the interior room side to prevent thermal energy losses when closed. Use of the channel and damper for injection of fresh air is recommended for use with the compact indoor unit option shown in FIG. 7 and FIG. 7*a*. Adjustment of the relative opening position of damper 68 is effected by manipulation of a cable or handle (not shown) attached to damper 68 and accessible external to the indoor unit. Mounted below channel 66 is rotary drive shaft 31, which rotates while supported by bearings 53 mounted within bearing housing 52, the bearing housing 52 being mounted within interface unit 24 using set screws 55. Channel 66 is anchored to bearing housing 52 using set screws 67. Tubes 69 for conveying condensate water are at the sides of bearing housing 52 near the bottom of interface unit 24, and are wrapped with a layer of thermal insulation 70.

Figure 7:
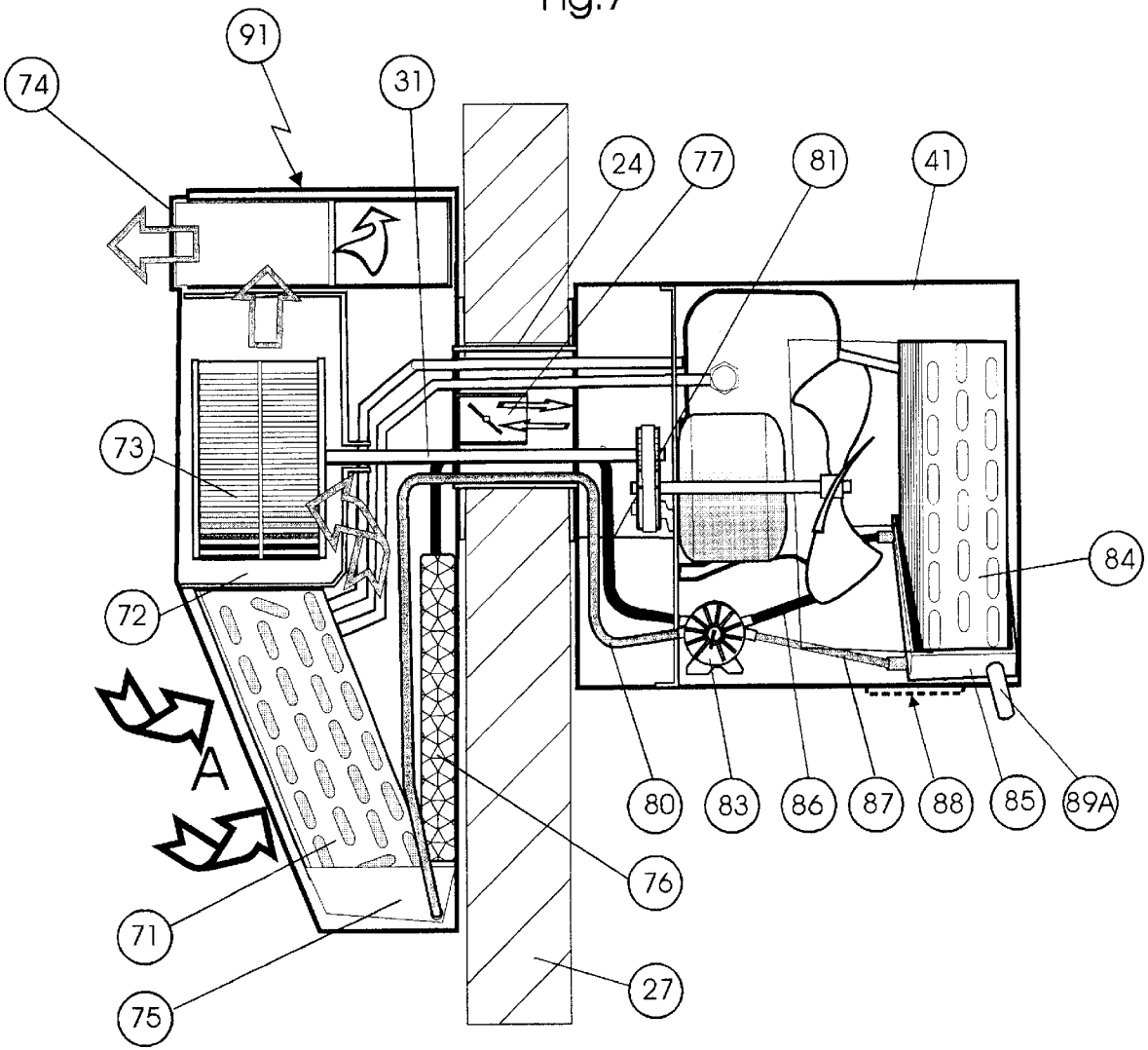
FIG. 7 is a sectional side view of a room air conditioner according to one embodiment of the invention in which the indoor unit is disposed in a compact configuration and includes an absorbent pad for humidifying the conditioned air.
Figure 7A:
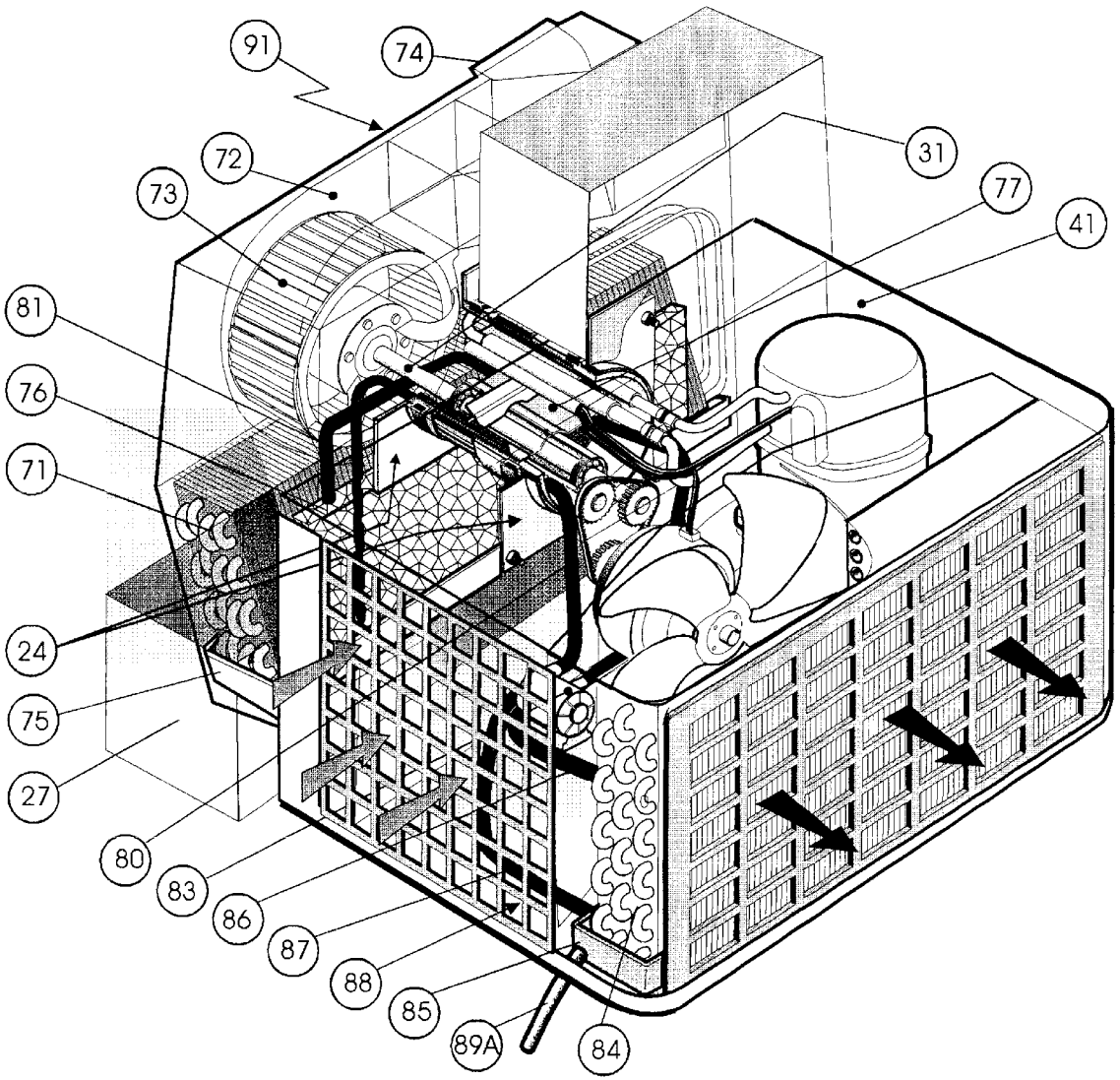
FIG. 7*a* is an isometric view of the room air conditioner shown in FIG. 7.

FIG. 7 is a sectional side view of a room air conditioner according to one embodiment of the invention, in which the interior unit 21 of the room air conditioner is disposed in a compact configuration and includes an absorbent pad for humidifying the conditioned air. FIG. 7*a* is an isometric view of this embodiment of the invention. This embodiment, includes a heat exchanger 71, an indoor condensed water collection pan 75, condensate removal tube 80 and water condensate feed tube 81. A single suction centrifugal fan 73 is attached to one end of a rotary shaft 82 within a spiral casing 72, which is disposed in spaced juxtaposed relation to indoor heat exchanger 71. Rotary shaft 31 penetrates interface unit 24, which is mounted within exterior wall 27. Rotary shaft 31 extends into exterior unit 41, where it is connected to and engaged by the electric fan motor rotary shaft (not shown). This connection is accomplished, in one embodiment of the invention, using a belt and pulley assembly (not shown), or in another embodiment of the invention, using a gear system (not shown). An absorbent pad 76 is disposed in juxtaposed position to indoor heat exchanger 71. When the air conditioner is operating in the heating mode, condensate water collected in collection pan 85 under outdoor heat exchanger 84 is pumped to absorbent pad 76 by reversible pump 83, saturating absorbent pad 76 with water. This results in humidification of the heated air stream prior to its conveyance to the room for the purpose of increasing the humidity content of the air to the desired level. In one embodiment of the invention, fresh air is drawn by suction from air inlet ports 88 of exterior unit 41 to the centrifugal fan 73 through fresh air duct 77 disposed in interface unit 24, where the fresh air stream blends with air stream A conveyed through indoor heat exchanger 71.

In one embodiment of the invention, in the cooling mode, reversible pump 83 conveys condensate water from indoor water collection pan 75 through tubes 80 and 86 to the top surface of outdoor heat exchanger 84, resulting in the cooling of outdoor heat exchanger 84. Excess condensate water is collected in outdoor unit collection pan 85 and discarded by draining through drain tube 89*a*.

Figure 8:
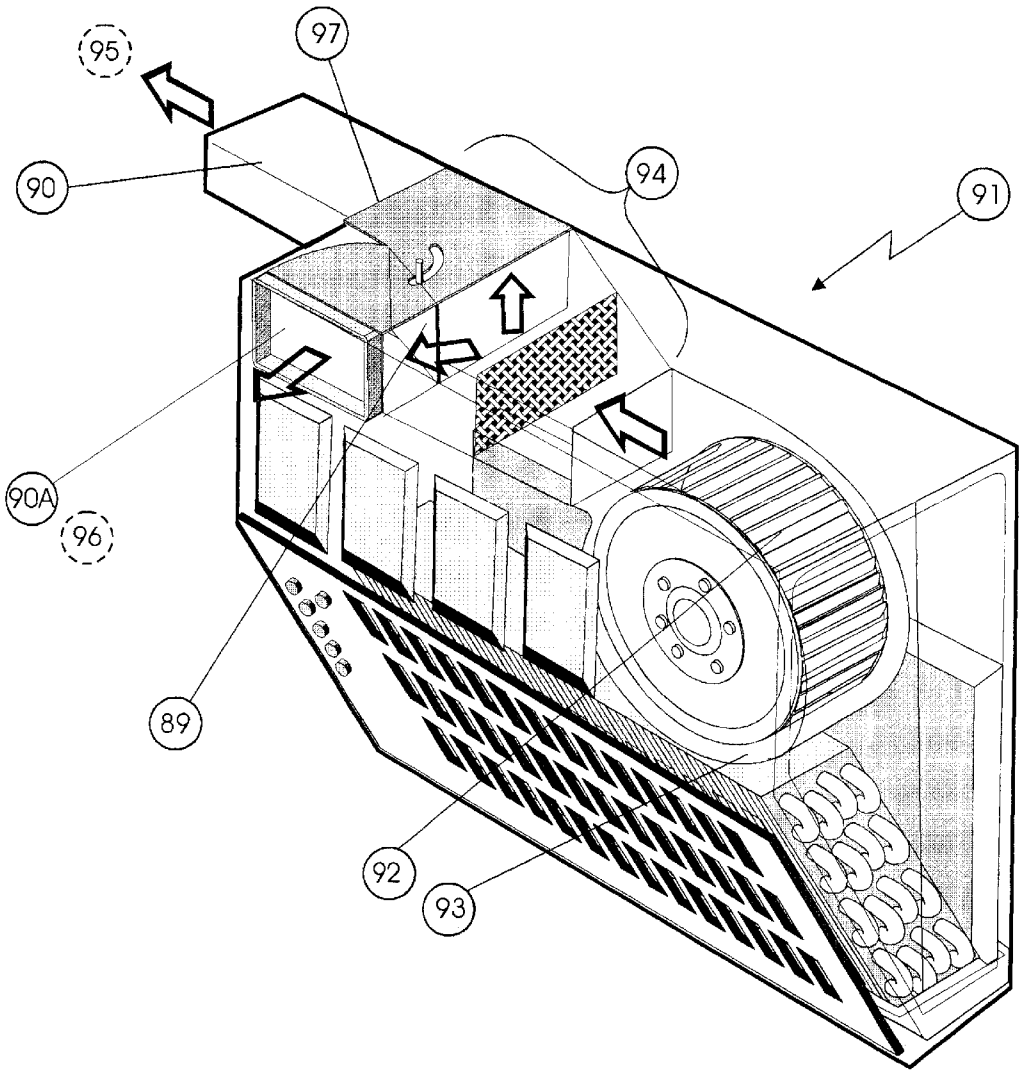
FIG. 8 is a sectional plan view of a room air conditioner according to one embodiment of the invention, in which conditioned air is conveyed to more than one room.

FIG. 8 is a schematic diagram of another preferred embodiment of the invention in which cooled air is conveyed from interior unit 91 to the interior of a first room 96 as well as to a second room 95. Duct 90 leading to second room 95 is connected to branched air outlet plenum 94, which is attached to the fan scroll casing 93 of interior unit 91. This permits conveying conditioned air by centrifugal fan 92 to first room 96 through duct 90A and/or second room 95 through duct 90. Adjustable damper 89 is mounted at the junction point of branched air outlet plenum 94 and inlet port 97 of duct 90. Adjustable damper 89 permits accurate regulation and distribution of the conditioned air flow rates conveyed to each room, and permits directing the air flow to only one of the rooms, if desired.

In the above embodiments of the invention, installation of the unit is limited to external building walls in which access to the room air conditioner is provided in the form of an appropriately-sized window or other suitable opening, to permit installation and service operations to be performed on the unit.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A room air conditioner mounted on an external building wall, the room air conditioner comprising:

(a) an indoor unit including:

(i) an indoor cabinet;

(ii) an indoor heat exchanger mounted in said indoor cabinet;

(iii) an indoor fan mounted in said indoor cabinet, and (iv) means for humidifying said indoor air, disposed in said indoor cabinet, (b) an outdoor unit including:

(i) an outdoor cabinet;

(ii) an outdoor heat exchanger mounted in said outdoor cabinet;

(iii) an outdoor fan mounted in said outdoor cabinet;

(iv) a fan motor mounted in said outdoor cabinet, and (v) a pump connected to a condensate transfer tube, and (c) an interface unit mounted within an opening in the external building wall, said interface unit for communicating between said indoor unit and said outdoor unit, wherein said condensate is conveyed by said pump to said means for humidifying said indoor air via said interface unit.

2. The room air conditioner of claim 1, wherein said means for humidifying includes an absorbent pad.

3. The room air conditioner of claim 2, said interface unit including:

(i) tubing for connecting said indoor heat exchanger and said outdoor heat exchanger.

4. The room air conditioner of claim 2, said interface unit including:

(i) cables for conveying electrical power and electronic control signals between said indoor unit and said outdoor unit.

5. The room air conditioner of claim 4, said interface unit further including:

(ii) a channel for conveying air between said indoor unit and said outdoor unit.

6. The room air conditioner of claim 1, said interface unit including a mechanism for conveying water from said indoor unit to said outdoor heat exchanger via said interface unit, and distributing said water so as to effect cooling of said outdoor heat exchanger.

7. A room air conditioner mounted on an external building wall, the room air conditioner comprising:

(a) an indoor unit including:

(i) an indoor cabinet;

(ii) an indoor heat exchanger mounted in said indoor cabinet, and (iii) an indoor fan mounted in said indoor cabinet;

(b) an outdoor unit including:

(i) an outdoor cabinet;

(ii) an outdoor heat exchanger mounted in said outdoor cabinet;

(iii) an outdoor fan mounted in said outdoor cabinet, and (iv) a fan motor mounted in said outdoor cabinet, and (c) an interface unit including:

(i) a rigid housing designed and configured to be installed through an opening in the wall; and (ii) a fan drive shaft, disposed within said rigid housing, said shaft engaged at a first end by said fan motor, and further engaging said indoor fan at a second end.

8. The room air conditioner of claim 7, wherein said interface unit, said indoor unit, and said outdoor unit are indirectly connected to the external building wall.

9. The room air conditioner of claim 7, wherein said interface unit, said indoor unit, and said outdoor unit are non-invasively connected to the external building wall.

10. The room air conditioner of claim 7, wherein said interface unit further includes:

(iii) a mechanism for adjusting a length of said rigid housing, such that said interface unit is adaptable to a thickness of the wall.

11. The room air conditioner of claim 7, wherein said interface unit further includes:

(iii) mounting plates rigidly attached to the ends of said rigid housing for mounting said indoor cabinet and said outdoor cabinet.

12. The room air conditioner of claim 7, wherein said interface unit is a sole unit connecting said indoor unit and said outdoor unit.

13. The room air conditioner of claim 12, wherein said interface unit includes a mechanism for adjusting a length of said rigid housing, such that said interface unit is adaptable to a thickness of the wall.

14. The room air conditioner of claim 7, wherein said interface unit further includes:

(iv) refrigerant tubing for connecting said indoor heat exchanger, said outdoor heat exchanger and a compressor of the room air conditioner;

(v) cables for conveying electrical power and electronic control signals between said indoor unit and said outdoor unit;

(vi) at least one tube for conveying water between said indoor unit and said outdoor unit, and (vii) a channel having an adjustable damper for conveying air between said indoor unit and said outdoor unit.

15. The room air conditioner of claim 13, wherein said mechanism for adjusting has threaded inner and outer cylinders.

16. The room air conditioner of claim 7, wherein said indoor unit further includes:

(iv) means for humidifying said indoor air, disposed in said indoor cabinet.

17. The room air conditioner of claim 16, wherein said indoor unit further includes:

a mechanism for conveying water from said outdoor unit to said means for humidifying said indoor air.

18. The room air conditioner of claim 16, wherein said means for humidifying includes an absorbent pad.

19. The room air conditioner of claim 7, said interface unit further including a mechanism for conveying water from said indoor unit to said outdoor heat exchanger via said interface unit, and distributing said water so as to effect cooling of said outdoor heat exchanger.

* * * * *